United States Patent [19]

Paxton

[11] Patent Number: 4,826,390

[45] Date of Patent: May 2, 1989

[54] SHEET HANDLING APPARATUS

[76] Inventor: Ronald Paxton, 4406 Bellflower, La Mesa, Calif. 92041

[21] Appl. No.: 185,417

[22] Filed: Apr. 25, 1988

[51] Int. Cl.[4] ..... E04F 21/18

[52] U.S. Cl. ..... 414/11; 269/904

[58] Field of Search ..... 419/10, 11; 269/904, 269/905

[56] References Cited

U.S. PATENT DOCUMENTS

| | | | |
|---|---|---|---|
| 1,582,147 | 4/1926 | Stanley | 414/11 |
| 3,143,219 | 8/1964 | Aldrich | 414/11 |
| 3,642,150 | 2/1972 | Zizak | 414/11 |
| 3,910,421 | 10/1975 | Panneton | 414/11 |
| 4,449,879 | 5/1984 | Mercer | 414/11 |

*Primary Examiner*—Leslie J. Paperner

*Attorney, Agent, or Firm*—Frank D. Gilliam

[57] ABSTRACT

Apparatus for lifting and supporting wallboard or other sheet material for horizontal or vertical installation on a ceiling or side wall of a structure. A pair of spaced apart identical pivot arms attach at one end to studs, joists or the like available in a building under construction and the other ends are connected together by an elongated bar or rod member. A clip or hanger supports the sheet material when the apparatus is in a vertical position and when translated toward the attachment to vertical studs the arms lock in this horizontal position. The apparatus can be operated in right or left direction of pivot. The apparatus can be easily stored in a small space by removal of the interconnecting rod.

5 Claims, 3 Drawing Sheets

SHEET HANDLING APPARATUS

BACKGROUND OF THE INVENTION

The invention disclosed herein relates to apparatus for handling sheet material such as wallboard of the kind utilized in the construction of the interior walls and ceilings of buildings, and particularly the invention relates to apparatus for facilitating the raising and support of such sheets in position for nailing to the studs and joists of such a building.

In the construction of dwellings and other buildings, it is quite common for the interior walls and ceilings to be formed by large sheets of a suitable material which are nailed or otherwise secured to the upright studs or horizontal joists of the building. The size of these sheets may vary, some being 4 feet by 8 feet, some being smaller and some larger. In any event, the size of such sheet has considerable weight, thereby further increasing the difficulty in the handling thereof. The utilization of such sheets to form the ceiling of a building is particularly difficult inasmuch as the sheet must be located quite precisely and supported manually until sufficient nails or other anchoring devices have been driven through the sheet material to enable it to be supported without manual assistance. The need for precise location of such a sheet, coupled with its size and weight, frequently require the services of two or more persons merely to locate and initiate nailing of the sheet. As a result, the expense of utilizing such sheets in the construction of a building is greater than it otherwise could be.

Prior art devices that have attempted to solve the above related problems and others include the following U.S. Pat. Nos.: 1,582,147 issued to J. C. Stanley; 2,883,073 issued to F. J. Morris; 3,305,219 issued to F. Rhodes; 3,143,219 issued to A. C. Aldrich; 3,467,261 issued to R. C. Jewell; 3,642,150 issued to Joseph P. Zizak and 4,449,879 issued to James E. Mercer.

J. C. Stanley teaches a rack device that can support a piece of sheet material place thereon, pivoted into position for nailing or otherwise attaching the sheet material to the ceiling and a length adjustable leg or prop is then placed to support the free end of the rack until the sheet material is attached to the ceiling joists. There is no teaching for use of the rack to hang vertical sheet material.

F. J. Morris teaches an elevator for positioning sheet material adjacent to the ceiling of a building. In use the device is loaded with a piece of sheet material, pivoted into position and then propped up until the sheet material is attached.

F. Rhodes teaches a device for installing sheet material which operates like the aforementioned devices except a ratchet and cable mechanism pivots the sheet material into attachment position and maintains the device in the last mentioned positioned until cranked to its first sheet material loading position. Like the previous references no provision is made for vertical installation of sheet material.

A. C. Aldrich teaches a pivotal sheet material rack type support with a leg or rod for supporting the rack when in a horizontal position.

R. C. Jewell teaches an easel type device for supporting sheet material for ceiling installation. The easel rotates intermediate its ends and is locked in at least a vertical and horizontal rotational position. A sheet of material is placed on the device when locked in a vertical position, then rotated to its horizontal positioned where it locked until the sheet material is attached to the ceiling Joseph P. Zizak teaches the use of a single beam pivoting device clamped to vertical studs for positioning sheet material adjacent to a ceiling for installation. In use, the sheet material is centered on the beam, the device is then rotated in place horizontal parallel with the ceiling and held in this position by a leg or support member.

James J. Mercer teaches a pivotal scaffold which is supported by a leg when in a horizontal position.

None of the aforementioned patents teach a device that can be used to hold in place sheet material for installation on both a horizontal or vertical surface.

Because of the continuing increase in the cost of labor in building construction, an improved sheet material positioning apparatus that can be utilized for both horizontal and vertical positioning which can be manipulated by a minimum of personnel will be widely acceptable.

SUMMARY OF THE INVENTION

The present invention is directed to an improved sheet material positioning apparatus which can be utilized to position sheet material vertically as well as horizontally. The device of the present invention comprises a pair of spaced apart arms. A rod extends between the distal ends of the arms and is loosely connected thereto. The rod provides a means for interconnecting the spaced apart arms so that one person can rotate both arms and the sheet material thereon. The arms are connected to a translating support through a wrist pin which is rotatably connected to the inner ends of the arms and fixedly connected to a translatable support member for rotation of the arms for placement of sheet material either vertical or horizontal when the device is attached to either joists or studs. The translatable support member is connected to a support clamp though a pivot pin and track relationship which allows the translatable support member to translate the arms toward and away from the support clamp member attachment to a joist or stud and also allows the arms to pivot relative to the clamp member attachment. When the clamps are attached to vertical studs for ceiling placement of sheet material, and the arms are rotated toward the ceiling about the pivot pin to a position perpendicular to the studs, the translatable member can then be translated via the pivot pin and track a distance toward the support clamp attachment where a locking tab attached to the clamp locks the arms in the last mentioned position thereby maintaining the sheet material adjacent to the ceiling until installed thereon. In this manner once the sheet material is rotated into position and locked in that position no additional support is required. When the clamps are attached to ceiling joists for sheet material installation to the ceiling, the arms are rotated upward at their distal ends to a position wherein the sheet material is parallel with the ceiling joists and when translated toward the clamps, the arms bear on the clamp and ceiling joists thereby maintaining the sheet material in that position.

A height adjustable clip is positionally attached to the distal ends of the arms to maintain the sheet material in position on the arms when in a vertical position;

An object of this invention is to provide an improved device for use for supporting sheet material for installation on both horizontal ceiling or vertical or wall surfaces.

Another object of this invention is to provide a device for the support of sheet material of any dimension for installation on elevated horizontal or vertical surfaces.

Another object of this invention is to provide a device for the installation of sheet material which can be easily disassembled and stored in a small space.

Still another object of the invention is to provide a device for supporting sheet material for installation on a ceiling that once it is pivoted into position can be locked in that position until the sheet material is secured in place.

Other objects of the invention are to provide a readily portable device for the support of sheet material for installation set forth which is comparatively simple in construction, strong, durable and safe, of light weight and which can be manufactured at low cost.

These together with other objects and advantages which will become subsequently apparent reside in the details of construction and operation as more fully hereinafter described and claimed, reference being had to the accompanying drawings forming a part hereof, wherein like numerals refer to like parts throughout, in which:

BRIEF DESCRIPTION OF THE DRAWING FIGURES

DETAILED DESCRIPTION OF THE INVENTION

Figure 1:
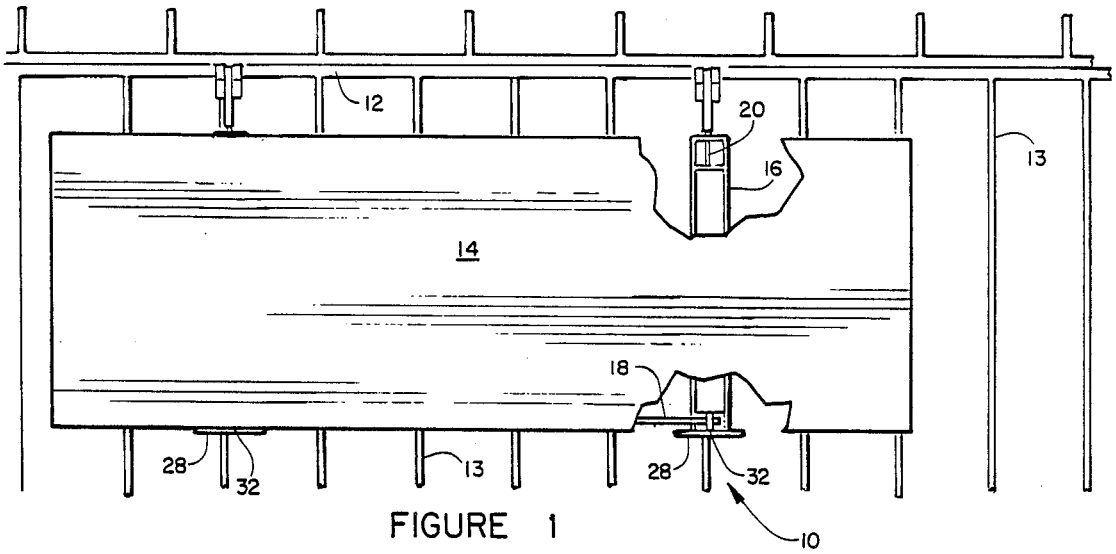
FIG. 1 is elevation view of the device of the invention attached to wall studs for loading vertical sheet material in position on the device for rotation to a horizontal position for ceiling installation.
Figure 3:
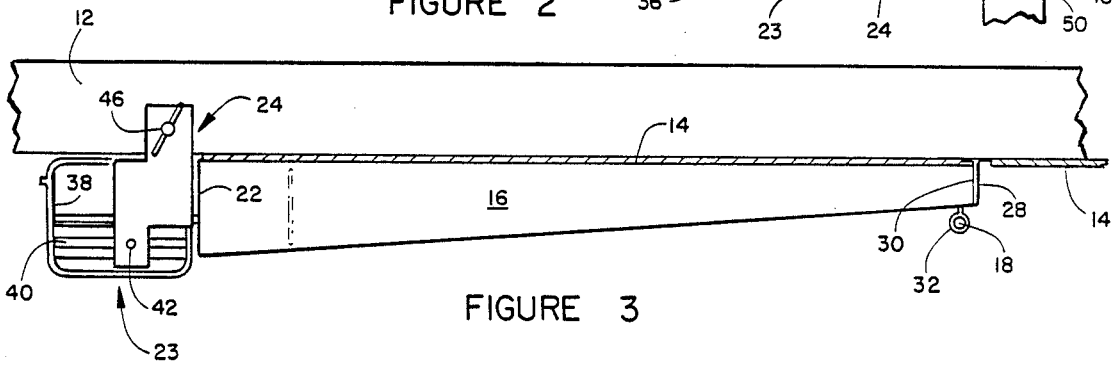
FIG. 3 is a side view showing of the device attached to ceiling joists for horizontal sheet material installation.
Figure 4:
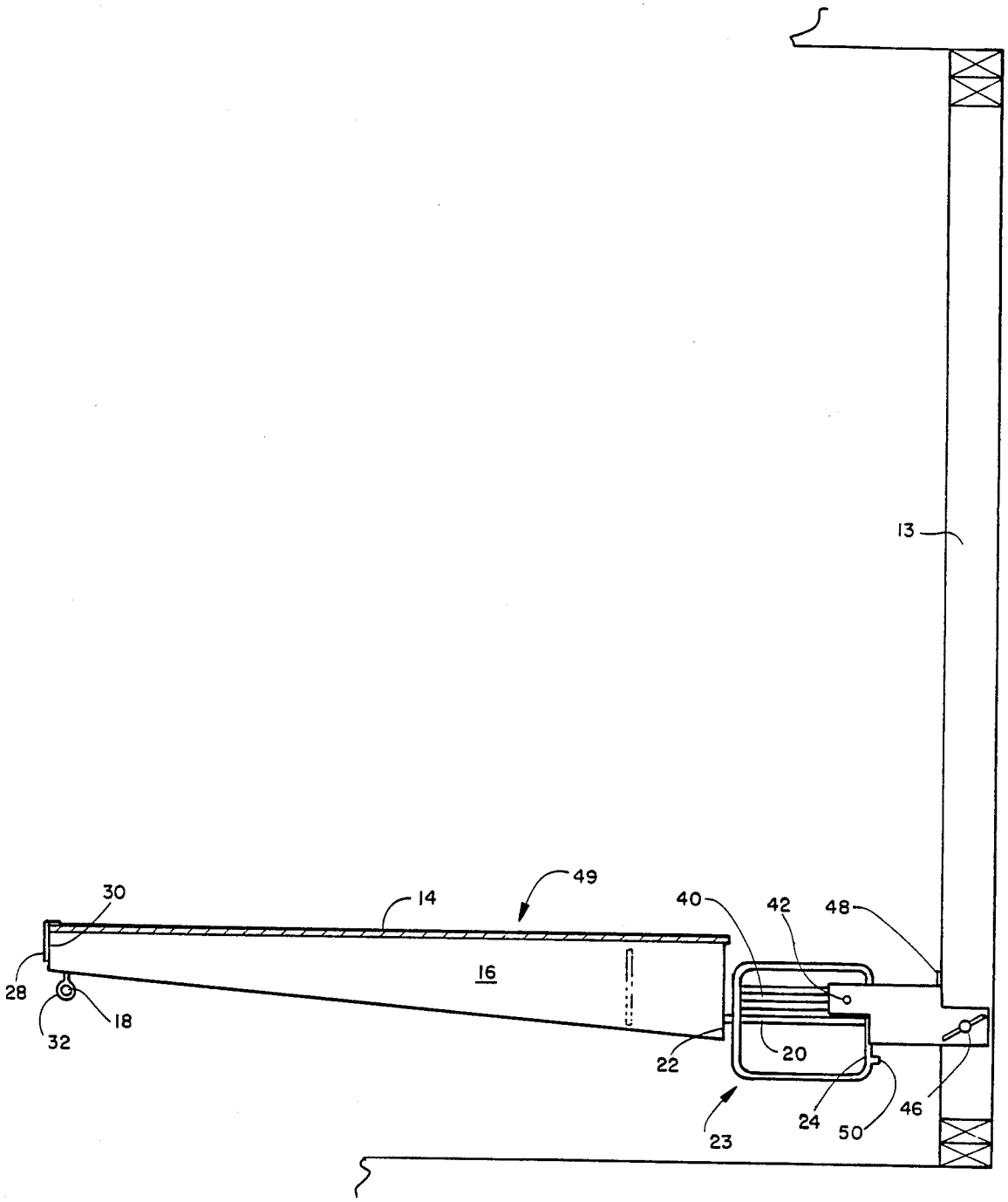
FIG. 4 is a side view of the device attached to studs with sheet material thereon for installation on a vertical surface.
Figure 5:
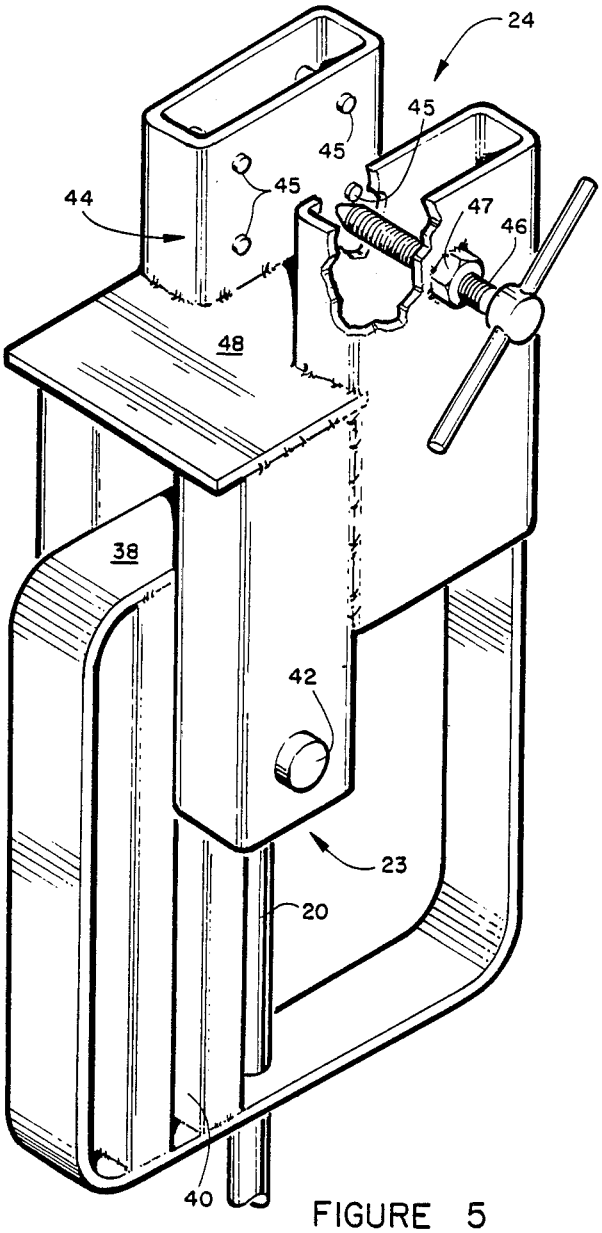
FIG. 5 is a detailed perspective showing of the clamp and arm attachment thereto.

Referring now to the various drawing FIGS. which disclose the present invention in detail. FIG. 1 depicts an elevation view of the device 10 of the present invention attached to wall studs 13 for supporting sheet material or the like 14 thereon prior to rotation to a horizontal position (see FIG. 2) adjacent the ceiling. The device 10 comprises a pair of arms 16 which are attached to the wall studs 13 in a spaced apart juxtaposed relationship. A rod 18 (see FIGS. 2 and 3) extends between the arms to allow one person standing centrally on the rod end to rotate the arms 16 upward from their outer ends simultaneously to a horizontal position substantially parallel with ceiling. A wrist pin 20 is rotatably attached to the ends 22 of the arms and is fixedly attached by welding or the like to an arm assembly 23 which is translatably carried by the clamp assembly 24 (see FIGS. 2–6). The wrist pins allows the arms to be rotated 180 degrees for using the device for hanging wallboard or the like on horizontal or vertical surfaces herein described in more detail. The arms are relocated along the joists 12 as wallboard 14 or the like is sequentially installed along the ceiling. A translatable clip 28 is attached to the distal end 30 of the arms to maintain the wallboard or the like in position until the device is rotated upwardly into the FIGS. 2 and 3 position wherein the clips 28 are translated away from the wallboard 14 for shifting of the wallboard into position for attachment to the ceiling joists. FIG. 4 is a side view of the device attached to vertical studs 13 with wallboard thereon for rotation along arrow 49 to a vertical position adjacent to vertical studs for vertical wall installation. The attachment and operation of the device in FIG. 4 is the same as in FIGS. 1 and 2.

Referring now specifically to the drawings FIGS. 2–7 which depict various showings of the arms and details thereof. Eye bolts 32 or the like are used for the loose attachment of the rod 18 to the distal ends of the arms. The rod maintains a loose fit in the central eye portion of the eye bolt. The wrist pin 20 is rotatably attached to the arm 16 at end 34 by a pair of nuts 36 threadedly engaging the pin and abutted together. A weld bead or head on the outer end 34 of the wrist pin could also be provided to accomplish this attachment. The opposite end of the wrist pin is fixedly attached to wall 38 of the arm assembly 23 by welding or the like. The arm assembly is translatably attached through an elongated slot 40 which is guided by a shoulder pin 42 fixedly attached to the clamp assembly 24. The arm assembly is translatable relative to the clamp assembly through the length of the slot 40 along the shoulder pin 42. A clamp 44 is provided for attachment of the device to a joist or stud. The clamp includes four fixed in place protruding member 45 that extend through approximately one eighth of an inch from one inner side wall of the clamp 44 and an oppositely positioned clamping bolt 46 in the other wall which is threadedly length adjustable through a fixed in position nut 47 attached to the outer clamp wall. The inner end of the clamping bolt 46 is pointed. When the clamp is installed on a joist or stud and the clamping bolt is threaded into the nut the pointed end penetrates into the joist or stud as do the protruding members 45. The device is rigidly held in place in this manner.

The clamp member 44 includes a backing plate 48 that bears against the outer surface of the joist or stud when the device is installed for use. A locking tab 50 is fixedly attached to the arm assembly outer housing. When the device is employed for positioning wallboard or the like on ceiling surfaces by attachment to vertical studs. The locking tab bears against the backing plate 48 when the arms are rotated upward from the FIG. 1 to the FIG. 2 position and translated the maximum amount toward the attachment studs. In this position the locking tap holds the arms in the FIG. 2 position until the arms are translated the maximum amount away from the attachment studs where they are free to rotated downward.

Figure 6:
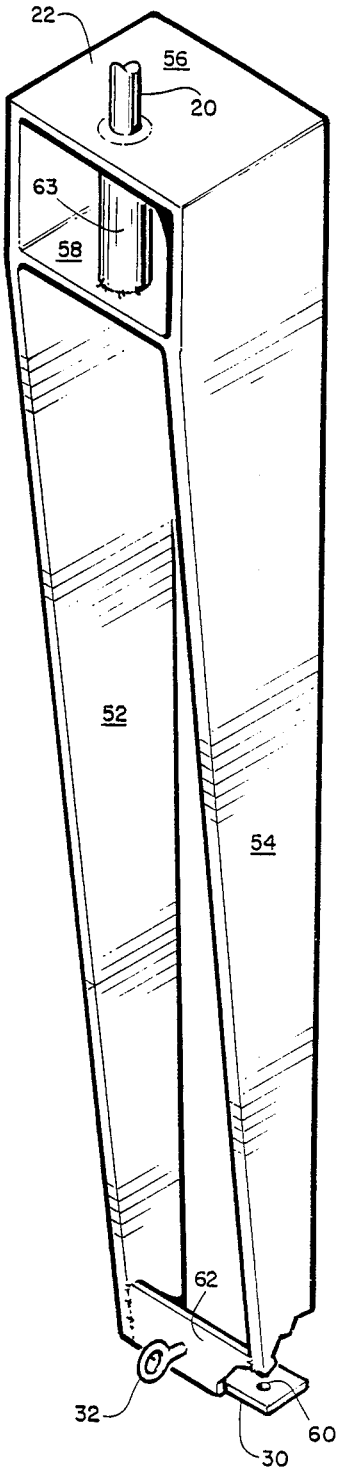
FIG. 6 is a plan view of one of the support arms of the invention.

As can be seen in FIG. 6, the arms include two side walls 52 and 54, an end wall 56 located on the clamp attachment end, an inner wall 58, a distal end wall 60 and a floor or surface plate 62. The walls 56 and 58 support an elongated tube 63 for rotational support of the wrist pin 20. The distal end wall 60 provides attachment for the translatable support clip 28.

Figure 7:
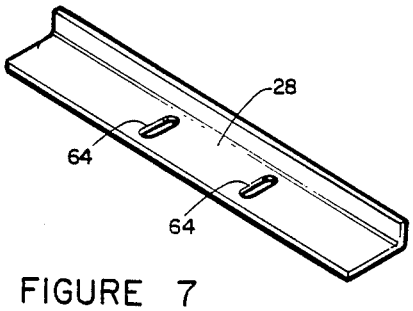
FIG. 7 is a plan view of the wallboard retaining clip and its means of attachment to the distal ends of the arms.

As can be seen in FIG. 7, the support clip 28 is translatably attached to end wall 60 via elongated slots 64. Nut and bolt combinations (not shown) secure the clip to the end wall 60. The eye bolt 32 is secured to the floor or surface plate 62. As shown FIG. 6, the end wall 60 and the floor or surface plate 62 may be an integral right angular formed element fixedly attached between to the side walls 52 and 54.

Figure 2:
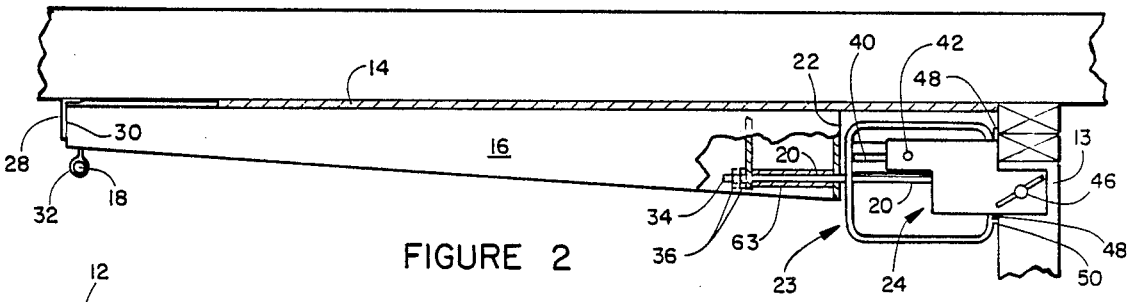
FIG. 2 is side view of the device of the invention attached to vertical studs for horizontal sheet material installation.

In operation a juxtaposed pair of the support arms of the invention are attached to either joists or studs for elevated horizontal (ceiling) or vertical (side wall) sheet material installation. The clip 28 is attached to the end wall 60 of the arms. A person or persons then place a piece of sheet material 14 on the surface of the arms beneath the extended clip surface. The arms and sheet material are then rotated about the shoulder pin 42 approximately 90° to horizontal position and translated toward the vertical studs as shown in FIGS. 2 and 3. Depending on whether or not the clamp is attached to the studs as shown in FIG. 2 or to the joists as shown in FIG. 3. The arms and sheet material are held in this horizontal position by the locking tab 50 bearing against backing plate 48 on the adjacent wall or arm assembly 23 bearing against the joist to which it is attached. After the arms are locked in position, the material may be moved away from the clip for exact positioning relative to the attachment surface.

It should be understood that the wrist pin 20 allows the arm assembly to be rotated 180 degrees from the FIGS. 2 and 4 position to allow the arms to be positioned as shown in FIG. 3.

Additional embodiments of the invention in this specification will occur to others and therefore it is intended that the scope of the invention be limited only by the appended claims and not by the embodiment described hereinabove. Accordingly, reference should be made to the following claims in determining the full scope of the invention herein.

What is claimed is:

1. A sheet material installing apparatus for attachment to either horizontal joists or vertical studs of a building under construction for positioning and installation of said sheet material horizontally or vertically comprising:

a pair of juxtaposed sheet material supporting arms;

a rod loosely attached between the distal ends of said arms;

an attachment means for attaching said arms to said joists or studs;

each of said arms being both rotatable about a first axis transverse to the arm between vertical and horizontal positions relative to said attachment mean and pivotal about an axis transverse to said first axis; and clip means translatably attached to the distal ends of said supporting arms.

2. The invention as defined in claim 1 additionally comprising a locking means for locking the arms in a horizontal position when said arms are attached to said studs.

3. The invention as defined in claim 2 wherein said locking means comprises a protruding tab carried by said arms that abuts against a surface of said attachment means thereby preventing rotation of said arms.

4. The invention as defined in claim 1 wherein said attachment means comprises a translatable bracket member rotatably connected to each of said arms, said bracket member is translatably attached to a mounting bracket, said mounting bracket includes a shoulder pin which mates with an elongated slot through said translatable bracket member and an open end which fits over said joists or studs, said open end includes fixed protruding elements and a length adjustable protruding element positioned opposite said fixed protruding elements, adjusting the length of said length adjustable protruding element causes all of said protruding elements to penetrate said joist or stud and be removably attached thereto.

5. The invention as defined in claim 1 wherein said rod is loosely held to said arms by an eye bolt.

* * * * *